United States Patent [19]

Paquette et al.

[11] 4,148,676

[45] * Apr. 10, 1979

[54] NON-WOVEN ARTICLES MADE FROM CONTINUOUS FILAMENTS COATED IN HIGH DENSITY FOG WITH HIGH TURBULENCE

[75] Inventors: Elmer G. Paquette, Madison; Karl R. Guenther, Stoughton, both of Wis.

[73] Assignee: Bjorksten Research Laboratories, Inc., Madison, Wis.

[ * ] Notice: The portion of the term of this patent subsequent to Nov. 27, 1990, has been disclaimed.

[21] Appl. No.: 845,419

[22] Filed: Oct. 25, 1977

Related U.S. Application Data

[63] Continuation of Ser. No. 617,059, Sep. 26, 1975, abandoned, which is a continuation of Ser. No. 419,626, Nov. 27, 1973, abandoned, which is a continuation of Ser. No. 189,150, Oct. 14, 1971, Pat. No. 3,775,210, which is a continuation-in-part of Ser. No. 876,005, Nov. 12, 1969, Pat. No. 3,616,002.

[51] Int. Cl.[2] ..... D04H 3/12

[52] U.S. Cl. ..... 156/181; 28/103; 427/421; 428/198

[58] Field of Search ..... 156/166, 177, 180, 181, 156/285, 286, 296, 433; 428/175, 195, 198, 227, 280, 281, 288, 290, 292; 427/256, 421; 28/72 NW, 72.3, 73, 76 R

[56] References Cited

U.S. PATENT DOCUMENTS

| | | | |
|---|---|---|---|
| 2,568,144 | 9/1951 | Cremer et al. | 428/280 |
| 3,220,904 | 11/1965 | Touey et al. | 156/180 |
| 3,313,665 | 4/1967 | Berger | 156/180 |
| 3,314,840 | 4/1967 | Lloyd | 156/181 |
| 3,369,948 | 2/1968 | Ostmann | 156/296 |
| 3,438,844 | 4/1969 | Kumin | 428/198 |
| 3,775,210 | 11/1973 | Paquette et al. | 156/181 |

*Primary Examiner*—John E. Kittle

*Attorney, Agent, or Firm*—Johan Bjorksten; John M. Diehl

[57] ABSTRACT

Non-woven articles, including garments and porous sheet materials, are made from continuous filaments by ejecting continuous yarn or filaments into turbulent air and contacting them with binder in a high density fog while still suspended in air, so that the binder dries sufficiently to become non-migrating before the yarn is deposited on the screen or mold on which the fibers are brought into contact with each other and bonding takes place. This method is particularly suitable for making garments of elastomeric fibers, not easily handled in ordinary production machinery. Another generally applicable advantage is that the resultant products are exceptionally flexible and that the articles produced do not split into stratified binder-rich and-poor areas, but are uniformly bonded throughout.

1 Claim, 12 Drawing Figures

NON-WOVEN ARTICLES MADE FROM CONTINUOUS FILAMENTS COATED IN HIGH DENSITY FOG WITH HIGH TURBULENCE

CROSS-REFERENCE

This application is a continuation of Ser. No. 617,059 filed Sept. 26, 1975, now abandoned, which was a continuation of Ser. No. 419,626 filed Nov. 27, 1973, now abandoned, which was a continuation of Ser. No. 189,150 filed Oct. 14, 1971, now U.S. Pat. No. 3,775,210, which was a continuation-in-part of application Ser. No. 876,005, filed Nov. 12, 1969, entitled NON-WOVEN ARTICLES MADE FROM CONTINUOUS FILAMENTS; now U.S. Pat. No. 3,616,002, and deals with a modification of the previously described invention whereby relatively rapid production methods are made possible.

FIELD

This invention relates to non-woven fibrous products and the manufacture thereof and has as its principal object an improved and more rapid method for producing garments and non-woven fabrics than is described in the cross-referenced application.

STATEMENT OF SCOPE

This invention relates to non-woven fibrous products and to manufacture thereof, and has for principal objects a method to produce comfortable and attractive garments without the use of sewing techniques, and also the production of soft and non-boardy non-woven fabrics.

STATEMENT OF PRIOR ART

Various methods have been used for producing preforms for subsequent impregnation with hardening resins to form automotive parts, boats and the like. These have included spraying glass roving onto perforated suction plates, and subsequent impregnation with resin, for example by means of suction, pressing and centrifugal casting. It is also known to make hats from felted fibers molded on forms, and set by resinous binders. Such methods have been used also with fibers to form non-woven textiles.

The difficulty heretofore encountered in producing such textiles, is that the binder customarily applied in a solution and subsequently dried during the drying process will migrate to the periphery, where the evaporation is most rapid. As a result, the binder is enriched on the surface of the web, resulting in stiffness, while the center portion thereof is starved on resin and easily parts or delaminates. It has been attempted to remedy this by applying the binder in solid form, by dusting or mixing throughout the fiber mass, but this procedure is far less rapid and convenient, and a significant portion of the binder material is wasted because it is either not lodged at crossover points of fibers, which by capillary forces selectively attract liquid binders, or they provide an excess of binder, suitable for stiff products such as shoulder pads, but undesirable for garments generally.

STATEMENT OF OBJECTIVES

An object of this invention is a bulky fabric or mat in which the binder is uniformly distributed throughout the fabric.

Another object is a method for producing fabrics or mats in which the binder is uniformly distributed throughout the structure.

Another object is a process for making a soft and pliable non-woven article, in which particles are deposited upon fibers uniformly from all sides, while such fibers are suspended in a gaseous medium, said particles having a viscosity higher than 100 centipoise as deposited.

Another object is a process for making a uniform non-woven article in which the binder is in solution in a volatile solvent, said binder being applied, and either much or substantially all of said solvent removed, while said fibers are suspended in a gaseous medium in only minimal contact with each other.

Further objects will become apparent as the following detailed description proceeds.

SHORT STATEMENT OF THE INVENTION

In accordance with our invention, we suspend continuous filaments in a gaseous medium of high turbulence and we apply a binder comprising a volatile solvent by providing a high density fog of the binder in the gaseous medium and we essentially remove much or most of said solvent while the filaments still remain suspended with the fibers essentially free from contact with each other. We are using the word "filament" in a broad sense to include any flexible textile strands, of essentially unlimited length, including also such strands or yarns as are made of a multiplicity of shorter fibers, such as for example staple yarns or cotton or woolen yarns. In this fashion, the stiffening of the binder prior to bringing the fibers into close contact with each other precludes further movement of the binder, particularly the migration which until now has greatly impaired the non-woven fabrics.

When the binder is applied so that a coherent film is formed over the surface of the fiber, the evaporation of solvent while the fiber still is suspended in the gaseous medium will impede further enrichment or local impoverishment by migration. When the binder is applied so as to form tiny droplets on the fiber surfaces, migration is likewise impeded by evaporation while the fibers are still floating in the gaseous envelope, substantially unrestrained by contact with each other. An additional advantage is gained in that those parts of the fibers which are free from resin retain their original suppleness and flexibility, so that the resultant product does not have the "boardy hand" or stiffness which until now has generally characterized non-woven fabrics.

THE DRAWINGS

The invention is further described with reference to the drawings wherein.

Figure 4:
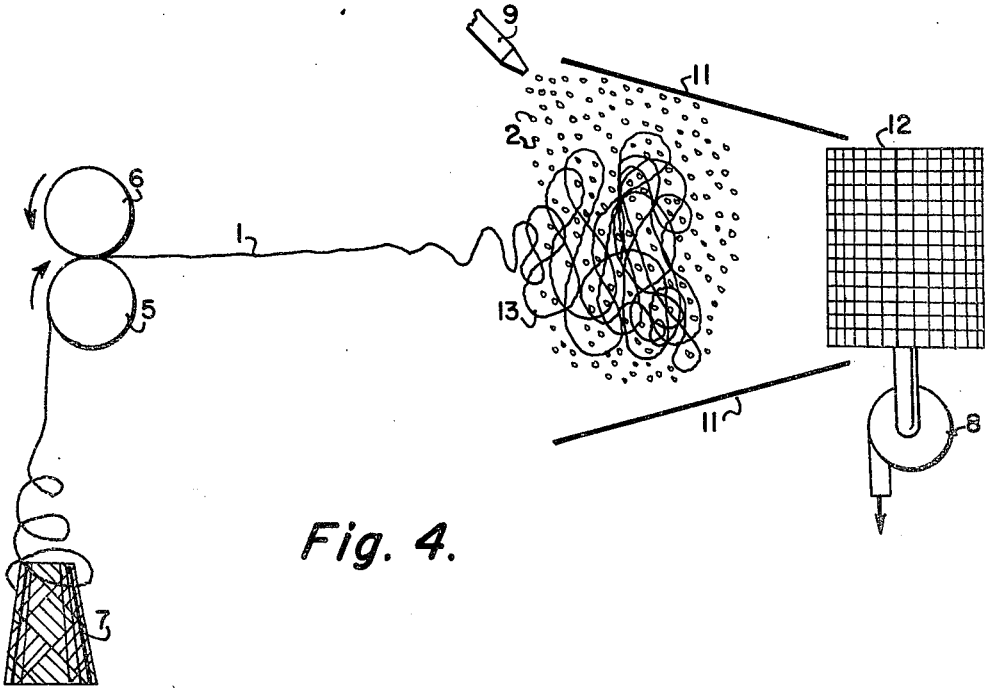
FIG. 4 is a schematic elevation.

Referring now to FIG. 4, 7 is a fiber supply such as a pirn or roll of a continuous fiber, 5 and 6 are projection means, in this case a pair of rollers 5 and 6, which rotate so as to advance the fiber, of which there may be many, so as to impart to them a velocity in the range of 60 to 10,000 ft/min and preferably 500 to 5,000 ft/min. The projected fiber 1 advances to a point where it has lost its velocity. Since new fiber is continually projected at high speed, but removed at a much lower rate, it will curl up in a three dimensional pattern of loops and tortuosities 13.

This pattern is relatively slowly drawn onto a moving screen 12, through which some air is being drawn by a suction means 14, so as to deposit the said three dimensional pattern onto said screen and remove it from the space in which it was formed.

While this tortuous pattern 13 is relatively stationary or moving at a speed not greatly different from the speed of the air surrounding it, it is dwelling in a dense cloud or fog of a small droplets of a binder composition, sprayed onto it by a nozzle 9. The space in which the fiber pattern 13 and the droplets of binder are present is confined by walls 11 so that spreading of the binder droplet beyond the confines of said space is limited, and the distribution of binder droplets within said space is substantially uniform.

Figure 1:
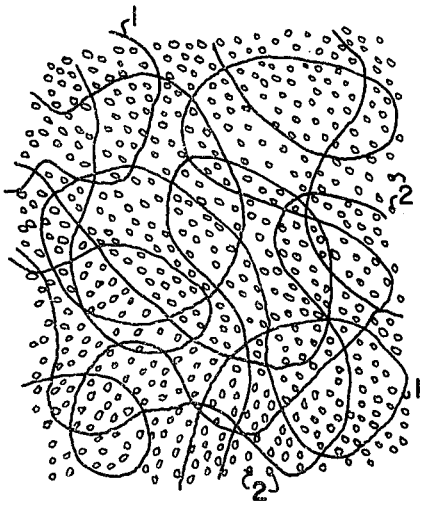
FIG. 1 is a schematic enlarged view of the coating step.
Figure 2:
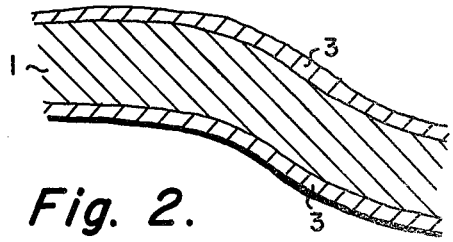
FIG. 2 is a schematic much enlarged view of binder on a fiber.
Figure 3:
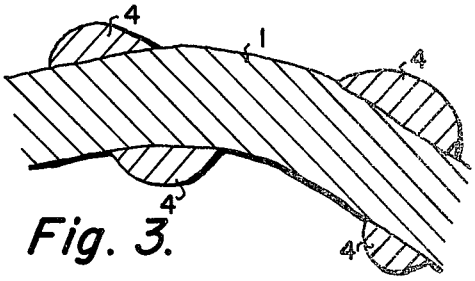
FIG. 3 is a schematic much enlarged view of binder on a fiber.

FIG. 1 shows the fibrous loops 1 suspended in a gaseous ambient, together with suspended droplets of binder 2. Both fibers and binder particles are moving in a gaseous of high turbulence and the droplets adhere to the fibers where these two components contact each other. If the droplet concentration is high, and the viscosity of the droplets low, and the wetting angle for the fibers low, then the binder may spread out along the fibers and form a substantially continuous layer on it as shown in FIG. 2; if the droplet concentration is lower, or the viscosity high, or the wetting poor, the droplets may become attached to the fibers as discrete particles shown in FIG. 3. The dwell in the gaseous ambient may be very short but is sufficiently long to evaporate enough of the solvent originally present to ensure that the binder will congeal into a kinetically stable state, whereby we mean a condition in which the binder will not respond to capillary spreading forces, but will stay put on the fiber, substantially without further migration or displacement on said fiber.

Thus, the binder becomes fixed onto the fibers in a state which resists further motion, before the fibers are brought in any extensive contact with each other.

Figure 5:
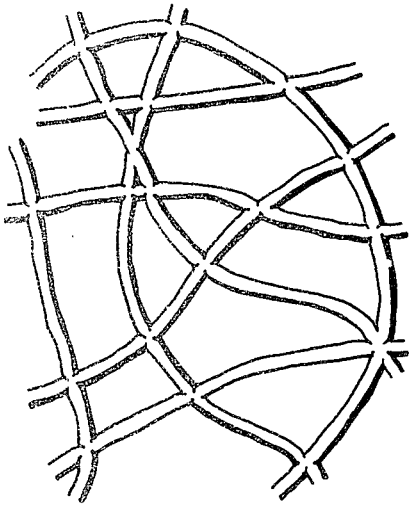
FIG. 5 is an enlarged fragmentary view of one embodiment of the product.
Figure 6:
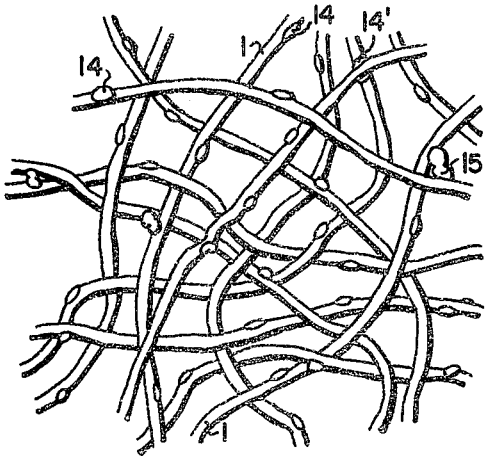
FIG. 6 is an enlarged fragmentary view of another embodiment of the product.

When the placement and kinetic stabilization of the binder on the fiber has taken place, the fibers are carried by air currents or gravity or a combination of both onto a moving screen or belt, where the fibers contact each other, and are bound together at the point where binder contact is effected, for example when a binder droplet on one fiber contacts a binder droplet on another, or at least a receptive, adherable spot on the other, to which said binder droplet can become firmly attached. The resultant structure may be as shown in FIG. 5 which illustrates a web made by compacting fibers such as those of FIG. 2, or may be as shown in FIG. 6 which shows a corresponding structure made of fibers such as those of FIG. 3. In FIG. 6 a point 15 is shown where bonding between fibers has been accomplished by the union of two of droplets 14 whereas a point where bonding is accomplished by a single droplet 14 is shown at 14'. Since the major portion of the fibers is free from binder, these fibers retain their original softness and suppleness, and are free from the poor "hand" or boardy feel that usually is associated with non-woven structures.

Figure 7:
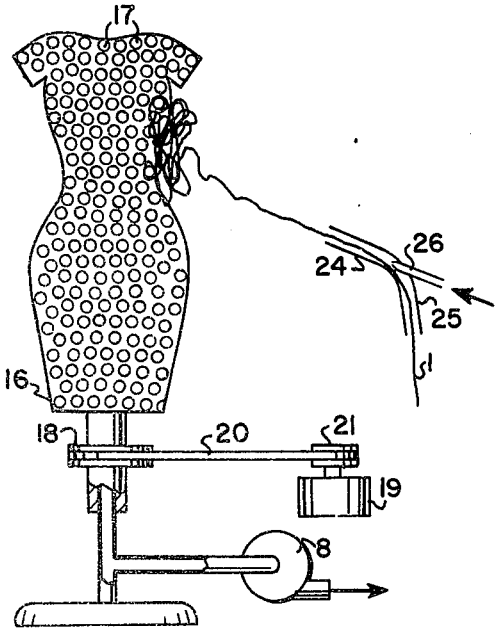
FIG. 7 is an elevation of the application of the invention to production of a garment.

Referring to FIG. 7, 16 is a mold for a lady's garment. This mold is covered over its entire surface with perforations 17, into which air is sucked continually by means of air moving means, 8, which exhaust the air from the hollow interior of mold 16 so as to create a continual suction through the perforations. A continuous fiber 1, in this case a 400 Denier woolen yarn, was projected toward the form by projection means which in this case are an air gun consisting of a tube 24, into which is fed at the distal end 25 the fiber to be projected onto the mold, and an air supply tube 26 into which air is fed to propel the fiber at high velocity. In the present case, the inner diameter of the said tube was 5/32", of the air supply tube was 1/16" and the air pressure used was 40 psi. The yarn was ejected at a rate of 1500 ft/min. Simultaneously a binder having the following composition: 48–49% polyvinyl acetate copolymer in $H_2O$—particle size 0.15 microns, was sprayed at 100 psi thru a fogging nozzle into the area of tortuous suspended fiber so as to form rapidly drying discrete droplets of binder thereon, which when the fiber reached the mold, were already dried to the point of being fixed in their positions and non-migrating. Pulley 18 attached to the base of the mold may be made to revolve continually by belt 20 which may be trained over pulley 18 and pulley 21 which may be driven by motor 19.

The air gun is moved by hand or by a programmable holder, so as to deposit the fiber at the desired rate. Often we prefer to spray a second reinforcing fiber, such as Nylon, "Dacron," or a high strength cellulose such as "Fortisan" onto area where particular reinforcement is desired, that is, where the rate of wear is accentuated in use.

This reinforcing fiber may be sprayed by a separate air gun or projector 30 which resembles the air gun just described, except that the dimensions of the tubes are linearly ½ smaller, to compensate for the smaller diameter of the high strength fibers. In this embodiment, we used 400 Denier woolen and 200 Denier Nylon.

The binder was caused to set by exposing the mold with fiber layer to a temperature of 320° F. while compressing it with a rubber roller by hand. We may also use inflatable balloons of a silicon rubber expanded within a small enclosure containing the mold to exert pressure to cause increased contact and bonding between fibers, or between different parts of the same fiber.

Upon completion, the finished garment was extended so as to slip over the protruding parts of the mold, and removed for use.

Figure 8:
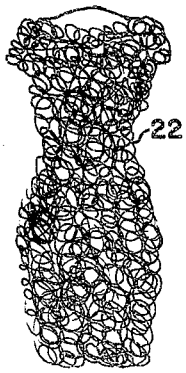
FIG. 8 is an elevation of the product of the step of FIG. 7.

The completed garment 22 is shown in FIG. 8.

It is critical to the invention to provide high fog density and high turbulence, i.e., high Reynolds number for the gas flow in the fog during the coating operation and a relatively short dwell time for the convolutions of fiber in the fog. Thereby relatively high production rates may be achieved.

Figure 9:
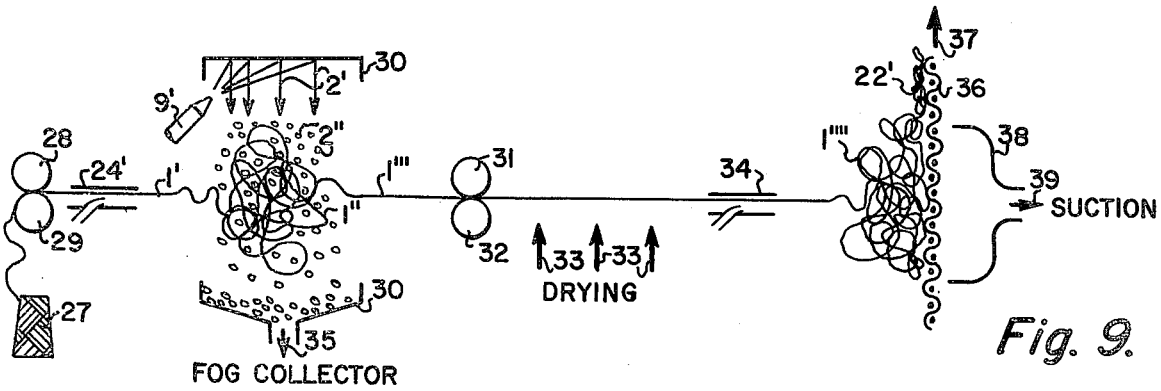
FIG. 9 is a schematic elevation of one embodiment of the process.

Thus, referring to FIG. 9, fiber 1' may be withdrawn from package 27 by rollers 28 and 29 and may be pulled from the nip of rolls 28 and 29 by injector apparatus or air gun 24' and introduced at a relatively high rate into the enclosure defined by numbers 30 wherein it may form convolutions as indicated at 1'. Nozzle 9' of a spray gun may be directed at a portion of one of members 30 or such other baffle member as may be provided to provide injection of resin being introduced into the interior of the enclosure provided by members 30 as indicated by arrows 2' to provide a fog of droplets of binder resin as indicated at 2'', surrounding convolutions are tortuous configurations of fiber 1' as indicated at 1''. Suitably high or great swirling motion of the fog or binder droplets 2' and the fiber 1'' may be provided by means not shown, for example, fan or air injectors or other means, and the fog density is made preferably relatively high. Swirling or turbulent motion which is characterized by Reynolds numbers greater than 8400 and preferably about 20,000 preferably does not provide a relatively high speed of flow of air or binder droplets in the direction of travel of fibers through the device. On the contrary, the general flow of air within the enclosure provided by members 30 is as indicated by arrow 35 to provide for collection and condensation of the droplets of fog into liquid form whereby they may be reinjected through nozzle 9'.

Fiber is withdrawn from convolutions 1' at a suitable rate as indicated at 1''' to remove the fiber from this convoluted configuration and provide a relatively straightened form as indicated at 1''', fiber being pulled from the enclosure provided by members 30 by any suitable means such as by rolls 31 and 32. From rolls 31 and 32 the fiber may be pulled by any suitable pulling apparatus such as by air gun 34 which may correspond to gun 24' or gun 24 and in between pulling means represented by roll 31 and 32 and pulling means represented by 34, the binder on the fiber may be dried. The drying may be accelerated by causing hot air or radiant heat to be directed against the fibers, as indicated by arrows 33.

Means such as indicated by rolls 31 and 32 may be used in place of gun 34 or a gun such as 34-a gun 34 or gun 24' may be used in place of rolls 31 and 32. Also, the pulling device represented by rolls 28 and 29 or that represented by gun 24' may in suitable instances be omitted.

Fiber emitted from pulling apparatus 34 may suitably be directed against an apertured screen 36 which may be caused to travel in the direction indicated by arrow 37 by reason of being a portion of the surface of a drum or endless belt of such screen material. The fiber may be caused to pile up in convoluted form as indicated at 1'''' to provide a non-woven fabric 22' deposited on a surface of a screen 36 in accordance with the invention. Piling up of the convolutions as indicated at 1'''' may be aided by providing plenum 38 from which air may be withdrawn as indicated by arrow 39 to provide air flow through the screen and thence through convolutions 1'''' to cause them to form into the product indicated at 22'.

Figure 10:
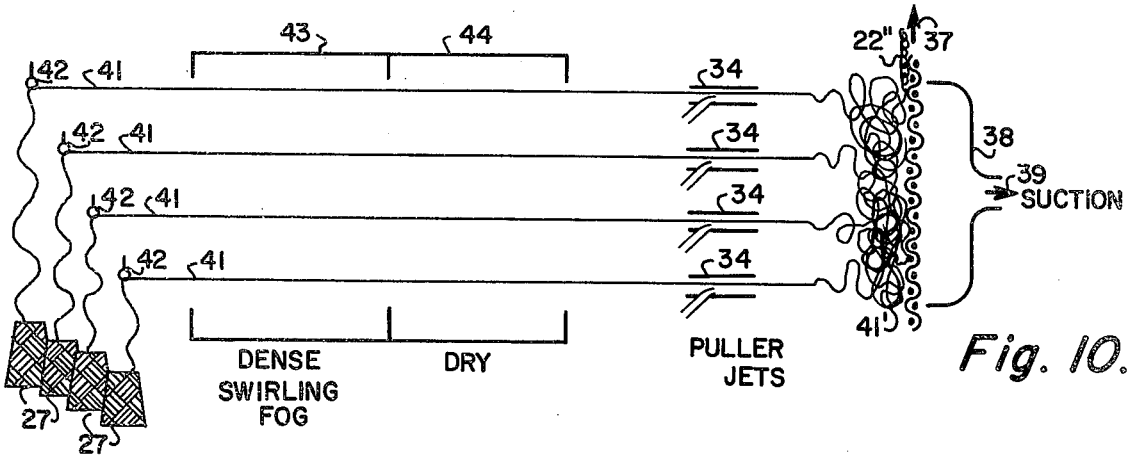
FIG. 10 is a schematic elevation of another embodiment of the process.
Figure 11:
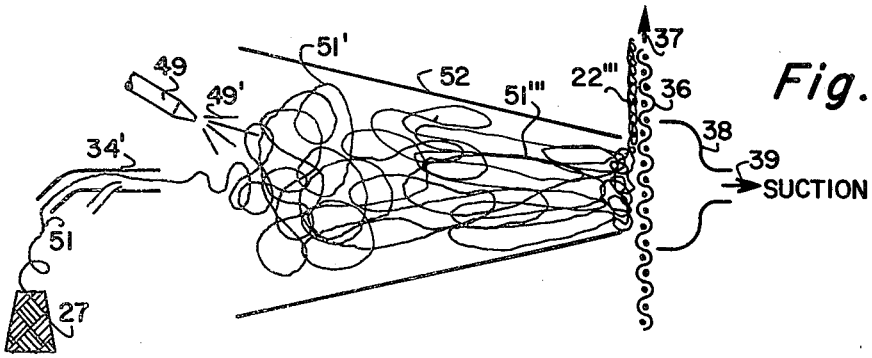
FIG. 11 is a schematic elevation of another embodiment of the process.
Figure 12:
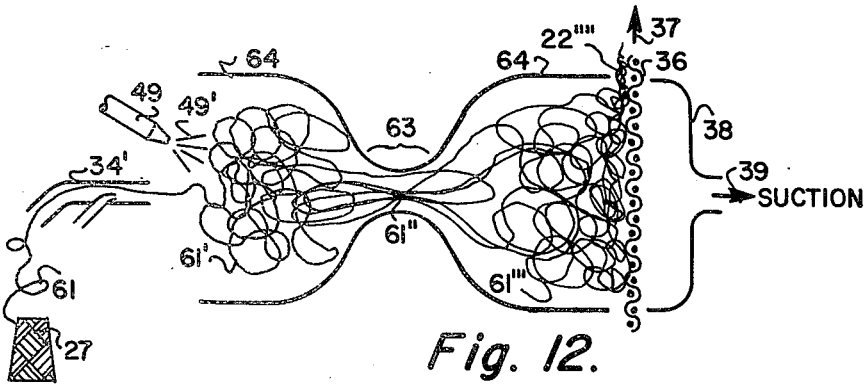
FIG. 12 is a schematic elevation of another embodiment of the process.

Similar products 22'', 22''' and 22'''' may be formed in the embodiments of FIGS. 10,11 and 12 by deposition on screen 36 as shown in those figures. Deposition to provide such products may be aided in each instance by providing plenum 38 and withdrawal of air as indicated by arrow 39.

In a modification of FIG. 10, convolutions are not provided during the coating step. High Reynolds number, that is, an extremely turbulent fog of binder droplets is provided as indicated in the zone 43. Travel of the fibers 41 therethrough is relatively rapid so that dwell of the fibers within the fog is relatively short, for example, as short as 0.001 to 0.000' second because the turbulence is high, being excess of a Reynolds number of 8400 and the density of the fog is high. A suitable amount of binder is deposited on the fibers despite the low dwell time. The binder on the fibers may then be somewhat dried as in the embodiment of FIG. 9 and the fibers, having partially dried binder thereon, may be deposited on screen 37 to provide product 22'' in the same manner as discussed in connection with FIG. 9.

In the embodiment of FIG. 10 a plurality of fibers 41 may be withdrawn from packages 27 passing through eyelets 42 and thence through area 43 in which a dense swirling fog of binder particles is provided and thence through area 44 in which fiber may be dried as discussed in connection with FIG. 9, the fibers being pulled from packages 27 through areas 43 and 44 by puller jets or air guns 34 which may direct the fiber against screen 37 where it may pile up in configuration 41' by reason of air friction prior to being finally deposited on screen 37 to provide product 22''.

In the embodiments of FIGS. 11 and 12, the process is carried out generally as in accordance with other embodiments except that a high Reynolds number or high degree of swirling motion is provided by causing the convolutions 51' of fiber 51 (in the corresponding fog of binder droplets surrounding them provided by resin 49' sprayed from nozzle 49) to travel at a relatively high rate at the portion of enclosure 52 provided by reduction in cross-sectional area of closure 52. In short, enclosure 52 is provided as a conical member having a large cross-sectional area at the left as viewed and a small cross-sectional area at the right as viewed adjacent to screen 37 whereby although travel of the convolutions and fog may be relatively slow as indicated at 51' it may be relatively great at 51'' as indicated by the straightness of the fibers therein by reason of increase in speed of ambient air flow as a result of reduced cross-section of member 52.

In contra-distinction, in the embodiment of FIG. 12 turbulence and high Reynolds number is provided at a central portion 63 of enclosure 64. Fiber 61 drawn from package 27 by air gun 34' to thence form convolutions 61' and fog or binder droplets provided by binder 49' dispensed from gun 49 are thence subjected to highly turbulent conditions in an area indicated at 63 by reason of being passed through venturi portion at 63 of enclosure 64, fibers in the venturi portion being relatively straight as shown as 61''. After passing venturi portion 63, the fiber configurations bend to become whorled and convoluted as indicated at 61''' prior to deposition on screen 37. By reason of the relatively high rate of deposition of binder onto the fibers, provided at the area of high turbulence in venturi portion 63, the dwell time of the fibers and the fog within enclosure 64 may be relatively short as, for example, on the order of 0.002 or 0.0002 second. Likewise, the dwell time of fibers 51 in enclosure 52 may be relatively short as on the order of 0.002 to 0.001 second or even 0.0002 to 0.0001 second.

EXAMPLES

The invention is further illustrated by the following specific examples:

EXAMPLE 1

A thread of 480 denier continuous filament Nylon is projected into the device shown in FIG. 9 and described above. The rate of projection is 3000 ft/min.

Piolon T-211 (Pioneer Chemical Works) diluted to 75% by volume with acetone is injected as the binder by means of a spraying device in which the binder is supplied at a pressure of 1500 psi, and projected againt the deflector, so as to break it up into droplets having an average diameter of 40 to 124 microns, and preferably 26 to 60 microns, which are in ambient having a high turbulence provided by introducing air, and become attached to said thread in a substantially uniform fashion. During this process and subsequent drying the binder loses solvent by evaporation to such a degree that it becomes non-migrating. Dwell time may be as low as 0.0001 second.

The coated fiber and binder combination is deposited on screen 37 where the fibers become compacted into intimate adhesive interaction with each other so as to form a coherent firmly bonded web 22.

The density of this web may be increased by compression between rollers to which the binder in its state at that point was non-adherent, such as poly tetrafluoro ethane ("Tefflon") coated rollers.

The resultant web is pliable and strong and shows no sign of stratification or binder migration.

EXAMPLE 2

A 70 Denier Nylon yarn was sprayed by suitable means for projecting this yarn continuously, such as the device shown and described above in conjunction with FIG. 4, onto a receiving means consisting essentially of a flat 14 mesh screen thru which air was being sucked at a speed of about 300 CFM. A binder solution consisting of 2.5% of a polyamide such as duPont Elvamide 8061 in methanol was simultaneously sprayed on, at a density of 2 gram/ft$^2$. Upon evaporation of the methanol, the binder caused the filaments to form adhesions at cross-over points so as to form a coherent article. The resultant non-woven fabric was pressed between sheets of 14 mesh screen at 25 psi and 320° F. for 2 minutes and cooled under the same pressure for 5 minutes. The average bending length of three samples was 10.5 cm. and the average breaking strength of three one-inch wide samples was 34.8 lbs. Thus, the breaking strength to bending lengths ratio was 3.32.

Extraction of the samples with boiling methanol indicated that the binder content was 30.1%.

Turbulence within enclosure 11 was high and dwell time therewith was as low as 0.4 sec. or 0.1 sec.

A similar sample was prepared by putting an air laid batt of chopped 3 denier nylon staple fibers 2" in length, with a 5% solution of Elvamide. 8061 in methanol, drying at 70° C., and pressed at 25 psi for 2 min. at 320° F. between pieces of 14 mesh screen and cooled for 5 minutes under the same pressure. The bending length of this sample was 9.8 cm. and the breaking strength 18.5 lbs. Thus the breaking strength to bending length ratio of this material was 1.89 or 57% of that prepared from the continuous yarn.

EXAMPLE 3

A 70 Denier Nylon yarn was projected onto a shaped 14 mesh evacuated screen, as indicated in FIG. 7 while simultaneously spraying with a binder solution consisting of 2.5% "duPont Elvamide 8061" in methanol. The molded article was removed from the screen and retained its shape as shown in FIG. 9.

The advantage of this invention are illustrated by the following comparative measurements of breaking strength:

When non-woven fabrics are produced from batts of chopped fibers via the application of a binder such as Elvamide 8061, the breaking strength of the fabric drops off markedly when the binder content is reduced from a level of 31.7 to a level of 25.1%. With fabrics produced with the same binder via the use of a continuous yarn, there is no loss in strength even when the binder content is reduced from a level of 30.1 to a level of 17.2%.

Furthermore, at comparable levels of binder, i.e., 30.1% and 31.7% the fabric produced from the continuous yarn had 1.9 times the strength of the fabric produced with chopped fibers.

The data substantiating these conclusions is shown in the following table:

Effect of Binder Concentration on the Breaking Strength of Non-Woven Fabrics Produced with Chopped Nylon Fibers and Continuous Yarns

| Fiber Form | % Elvamide 8061 | Breaking Strength of 1" Wide Sample (lbs) |
|---|---|---|
| Chopped | 31.7 | 18.5 |
| Chopped | 25.1 | 8.9 |
| Continuous Yarn | 30.1 | 34.8 |
| Continuous Yarn | 17.2 | 35.3 |

EXAMPLE 4

An acrylic latex containing 50% solids in water and known as "Ucar 891" (Union Carbide) was diluted with an equal weight of acetone, and sprayed with an airless vibration sprayer known as "Jiffy Electric Sprayer," made by Astro Products Co., Branford, Conn. The following fibers were projected simultaneously with the above into the fog of acrylate droplets at the rate of 1000 ft/min: in sequence, 200 Denier crimped Nylon; 30-20-R20-56 duPont Dacron; a 50-10-S-280-SD Nylon (duPont).

Microphotographs taken of the resultant webs showed unmistakably the deposition on the fibers of discrete, separate beads of the resin, sometimes bridging and bonding fibers together, but always separated by stretches of fiber free from any visible coating.

In producing these webs, we varied the air suction in the range of 3000 to 10,000 cubic feet per minute, through a 20"×40" screen. The thickness of the web produced in this example was from 0.01" to 1". Cure was effected at 320° F., partly in a press at 25 psi, partly without pressure in oven. The indicated dwell time of the convoluted fibers in the fog of binder was perhaps as low as 0.0001 sec. in some instances.

EXAMPLE 5

A non-woven fabric was made from 800 Denier crimped Nylon, projected onto window screening, utilizing "Flexbond 330" (Airco Chemicals & Plastics Co.)

diluted with 75% of its volume by weight of methanol as a binder and utilizing substantially the apparatus of FIG. 11.

EXAMPLE 6

70 Denier ("Spandex" duPont "Lycra") was utilized with "Urethane Latex X-1042" (Wyandotte Chemicals Corp.) diluted with 70% by volume of n-butyl acetate: 7-1-0-280-sd, as binder is substantially the apparatus of FIG. 11 to make a non-woven fabric.

EXAMPLE 7

Nylon monofilament (duPont) was utilized with "Polyco 2114" (Borden Chemical Co.) diluted 65% by volume with acetone as binder to make a non-woven fabric in substantially the apparatus of FIG. 11.

EXAMPLE 8

"70-34-RO-56" polyester yarn (duPont "Dacron") utilized with the following binder: "Hycar 2671" (B.F. Goodrich Chemical Co.) diluted 70% by volume with acetone, in substantially the apparatus of FIG. 11 to make a non-woven fabric.

All of these procedures resulted in attractive fabrics or mats of much improved softness over corresponding products made according to prior art.

While the above examples illustrate some of the embodiments of the invention, it is evident that the scope is substantial. The fabrics of the invention have a thickness generally higher than 0.007"., as below this level the plasticizer migration due to flow of the binder during the drying step is not accentuated, and most strongly applies to fabrics having a thickness range from 0.010" to 0.600".

The present invention is particularly valuable in the fabrication of garments from fibers so elastic that they cannot be handled at normal production speeds on a knitting machine or on weaving equipment. Thus, the invention is particularly applicable to fibers having a rubberlike character, the elasticity being generally characterized by anfully reversible elongation of more than 100%.

The resultant products are characterized by the absence of the previously prevalent migration of binder to the outer layers in the drying process. Thus, the central layers of the fabrics of the inventions are substantially indistinguishable from the outer layers on the basis of binder concentration, boardiness, stiffness and bonding strength, and the fabrics do not tend to part along planes of stratification when pulled apart by force applied perpendicularly to a flat surface.

The particles of the binder projected as a fog have a viscosity which at the time they become attached to the fibers, and these are allowed to aggregate, is sufficient to prevent capillary migration. This is generally a viscosity higher than 1000 centipoise. To retain the ability to bind, there should be still some cohesive tendency. The upper limit of viscosity at the bonding step is generally about $10^5$, however, this is more readily adjusted and can be reached for example by application of heat in the bonding process, so as to effect adhesion when the adhesive at room temperature has hardened to a point where adhesiveness had all but vanished.

We prefer to employ binders in which the particles of the fog when sprayed comprise 10% to 50% of solid, 5–15% of a liquid solvent therefore which has a boiling range substantially between 75° and 120° C. and 55–75% having a boiling range substantially between 37° and 48° C.

We contemplate a structure of continuous filaments which have distributed substantially uniformly on their surface discrete, non-connected droplets of adherent resinous or polymeric material. The droplets in question are in the finished article substantially dry to the touch, but have been made to form bridges or points of adhesion between the fibers where they touch two fibers, or droplets on another fiber usually at intersections of the fibers or filaments, or where these touch or almost touch each other. The bonding may have been effected at a stage of the process when the droplets were not yet quite dry to the touch, but yet dry enough to resist any capillary forces which might cause excessive spreading out or migration.

The fibers or yarns sprayed in this process are practically endless, so that they can be sprayed through the projection means as a continuous stream of connected matter. So long as this is possible, it does not matter greatly if a continuous yarn is made of continuous filament, or by spinning staple fiber, or natural fibers such as cotton, jute or wool.

The particularly preferred fibers are those which cannot otherwise be made into elastic knit structures, such as fibers or yarns of rubber, or of elastic polyacrylates, or elastomeric polyurethanes having elastic extensibility in excess of 100%, such as "Lycra." The invention is applicable to fibers of the synthetic thermoplastics, such as "Nylon," polyethylene glycol terophthalate, polyvinyl fluoride, split film fibers, for example of polypropylene, polyolefin fibers generally, polyphenoxide fibers, polyoxymethylene, also to fibers extruded or drawn as thermoplastic but subsequently crosslinked, chemically or by exposure to ionizing radiation, and which may even decompose before melting, polyacrylate or methacrylate fibers, and the like, including also fibers not yet invented but of substantially equivalent mechanical properties to the above.

While the binder compositions are preferably solutions, when rapid spraying and drying is desired, we may also in some cases employ water latices. When these are sprayed, we prefer to maintain the mold at a temperature of about 180°–230° F. in order to enhance the rate of evaporation. Suitable latices are, for example:

"Ucar 891" — Union Carbide, Inc.

"Urethane Latex, Type X-1042" — Wyandotte Chemical Corp.

"Flexbond 330" — Airco Chemicals & Plastics, Inc.

The water latices are preferably used with slit film type of fibers having a width of at least 15 microns, or with fast drying synthetic monofilaments.

With "kinetic stability" we mean stability to capillary and other surface forces, so that a droplet or film deposited will stay put when the fiber is deposited on the mold or where its final bonding takes place, and will not then further spread or migrate so as to change the distribution or concentration thereof.

With "contact points" we mean those points on the fibers where they come in contact with another fiber, or another part of the same fiber so that bonding can be effected.

To provide fiber convolutions in the gaseous ambient in which the convolutions are contacted by the binder fog, it is necessary to give the continuous filament or yarn a high initial velocity and to decelerate it to at least half its initial velocity by contact with the air into which it is projected, so as to induce the formation of the tortuous or curvilinear patterns described. Fiber velocity, ambient turbulence and fog density are preferably sufficiently high to provide the desired coating with a dwell time of the fiber in the fog of as little as 0.001 sec. or even 0.0001 sec.

Having thus disclosed our invention, we claim:

1. The process for producing a non-woven structure which comprises spraying into a gaseous ambient a solvent containing resinous binder medium so as to form a fog of substantially suspended droplets, passing continuous filaments through said ambient, imparting to the ambient lateral velocities relative to said filaments, to provide Reynolds numbers in excess of 8400 in said ambient, maintaining said filaments within said fog for at least 0.0001 sec. so as to cause the droplets of fog to settle upon said filaments, drying the material coated on the filaments to a viscosity greater than 1000 centipoise to thereby cause the material to stiffen to preclude the further movement of binder relative to the filaments, depositing the filaments in random configurations on a receiving means and evaporating residual liquid from the material on the filaments so as to cause the filaments to adhere to each other at points of contact.

* * * * *